US008200140B2

(12) United States Patent
Tyson et al.

(10) Patent No.: US 8,200,140 B2
(45) Date of Patent: Jun. 12, 2012

(54) MODULAR PRINTING SYSTEM HAVING A MODULE WITH A BYPASS PATH

(75) Inventors: Jacqueline Y. Tyson, Rochester, NY (US); Andrew J. Bonacci, Webster, NY (US); Michael J. Diehl, Rochester, NY (US); Colleen R. Enzien, Penfield, NY (US); Thomas E. Higgins, Fairport, NY (US); David R. Kretschmann, Webster, NY (US); Carlos A. Lopez, Webster, NY (US); Ana P. Tooker, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 233 days.

(21) Appl. No.: 12/424,604

(22) Filed: Apr. 16, 2009

(65) Prior Publication Data

US 2010/0264574 A1 Oct. 21, 2010

(51) Int. Cl.
*G03G 15/00* (2006.01)

(52) U.S. Cl. ..... 399/381; 399/388

(58) Field of Classification Search ..... 71/279, 71/280, 303; 399/381, 388, 361, 21; 271/279, 271/280, 303

See application file for complete search history.

(56) References Cited

U.S. PATENT DOCUMENTS 3,603,680 A 9/1971 Barton
5,457,524 A * 10/1995 Metcalf et al. ..... 399/382
5,518,230 A 5/1996 Scarlata et al.
5,574,527 A 11/1996 Folkins
5,815,766 A * 9/1998 Miller et al. ..... 399/21
5,970,274 A 10/1999 Rath
6,101,364 A * 8/2000 Boehmer et al. ..... 399/361
6,256,463 B1 * 7/2001 Manzer et al. ..... 399/76
6,507,725 B1 1/2003 Adams et al.
6,560,415 B2 * 5/2003 Hirako et al. ..... 399/18
6,748,186 B1 6/2004 Skrainar et al.
6,973,286 B2 * 12/2005 Mandel et al. ..... 399/391
7,024,152 B2 * 4/2006 Lofthus et al. ..... 399/391
7,136,616 B2 * 11/2006 Mandel et al. ..... 399/388
7,280,771 B2 10/2007 Mandel
7,280,781 B2 10/2007 Willis
7,444,108 B2 * 10/2008 Moore et al. ..... 399/381
7,575,232 B2 * 8/2009 Willis ..... 271/225
7,680,448 B2 * 3/2010 Mandel et al. ..... 399/381
7,787,138 B2 * 8/2010 Lofthus et al. ..... 358/1.15

(Continued)

OTHER PUBLICATIONS

Bober et al., U.S. Appl. No. 12/211,853, filed Sep. 17, 2008.

(Continued)

*Primary Examiner* — Kaitlin Joerger
(74) *Attorney, Agent, or Firm* — Gibb & Riley, LLC

(57) ABSTRACT

Disclosed are embodiments of a modular printing system with one or more modules having one or more bypass paths and comprise a modular printing system with a module (e.g., a stacker or feeder module) having a main compartment and at least one additional compartment. Contained within the main compartment is a main sheet transport path and a functional component (e.g., a sheet stacking device or a sheet feeding device) connected to the main sheet transport path. Contained with the additional compartment is a bypass path. The bypass path allows sheets to be routed through the module in the event of a print media sheet jam in the main sheet transport path. Because the bypass path is contained within a separate compartment, the jam can be cleared from the main compartment without cycling down the printing system, thereby allowing for continued productivity.

13 Claims, 3 Drawing Sheets

U.S. PATENT DOCUMENTS

| | | | | |
|---|---|---|---|---|
| 7,811,017 | B2 * | 10/2010 | Spencer et al. | 400/624 |
| 7,819,401 | B2 * | 10/2010 | Moore | 271/314 |
| 2004/0251607 | A1 | 12/2004 | Mandel et al. | |
| 2006/0214352 | A1 | 9/2006 | Clark | |
| 2007/0140767 | A1 * | 6/2007 | Mandel et al. | 399/381 |
| 2008/0079210 | A1 | 4/2008 | Nakada et al. | |
| 2008/0145090 | A1 | 6/2008 | Robinson | |
| 2008/0265483 | A1 | 10/2008 | Hermann | |

OTHER PUBLICATIONS

Mandel et al., U.S. Appl. No. 12/331,768, filed Sep. 10, 2008.

* cited by examiner

MODULAR PRINTING SYSTEM HAVING A MODULE WITH A BYPASS PATH

BACKGROUND AND SUMMARY

Embodiments herein generally relate to modular printing systems and, more particularly, to a modular printing system incorporating a module, such as a stacker or a feeder module, having a bypass path.

Modularity in printing systems, such as electrostatographic or other types of printing systems, is known. For example, each of the following patent documents assigned to Xerox Corporation of Norwalk, Conn., USA, and incorporated herein by reference in their entirety disclose modular printing systems: U.S. patent application Ser. No. 12/211,853 of Bober et al., filed on Sep. 17, 2008; U.S. patent application Ser. No. 12/331,768 of Mandel et al., filed on Dec. 10, 2008; U.S. Patent Publication No. 2008/0265483 of Hermann, published on Oct. 30, 2008; U.S. Patent Application Publication No. 2006/0214352 of Clark, published on Sep. 28, 2006; U.S. Pat. No. 6,748,186 of Skrainar et al., issued on Jun. 8, 2004; U.S. Pat. No. 7,280,771 of Mandel et al., issued on Oct. 9, 2007; and U.S. Pat. No. 7,280,781 of Willis, issued on Oct. 9, 2007. Each of these modular printing systems comprises multiple modules (i.e., discrete interchangeable units), each of which comprises one or more functional components (e.g., sheet feeders, printing engines, sheet inverters, sheet buffers, sheet finishers, sheet stackers, etc.) contained within a supporting frame and housing (i.e., within a cabinet).

Oftentimes multiple modules with essentially the same functional component (i.e., redundant modules) will be connected in series within a single modular printing system to provide additional capacity (e.g., printing capacity, stacking capacity, feeding capacity, etc.). For example, multiple printing engine modules are connected in series in tightly integrated serial printing (TISP) architectures (e.g., see U.S. Pat. No. 7,280,771 incorporated by reference above) to provide both single color (i.e., monochrome) and/or multi-color printing. Additionally, multiple stacker modules can be connected in series downstream from a printing module to ensure sufficient sheet storage capacity at output (e.g., if one stacker becomes full, the next stacker in the series will be used, see U.S. Patent Publication No. 2008/0265483 incorporated by reference above). Finally, multiple feeder modules can be connected in series upstream from a printing module to ensure that a sufficient sheet feeding capacity and/or to ensure that a desired sheet feeder rate is achieved (e.g., see U.S. Patent Publication No. 2006/0214352 incorporated by reference above). Unfortunately, modular printing systems such as those described above incorporating series-connected redundant modules and, particularly, incorporating series connected stacker and/or feeder modules, must cycle down completely in order to clear a print media sheet jam (e.g., a paper jam).

In view of the foregoing, disclosed herein are embodiments of a modular printing system with one or more modules having one or more bypass paths. Specifically, embodiments disclosed herein comprise a modular printing system with a module (e.g., a stacker or feeder module) having a main compartment and at least one additional compartment. Contained within the main compartment is a main sheet transport path and a functional component (e.g., a sheet stacking device or a sheet feeding device) connected to the main sheet transport path. Contained with the additional compartment is a bypass path. The bypass path allows sheets to be routed through the module in the event of a print media sheet jam in the main sheet transport path. Because the bypass path is contained within a separate compartment, the jam can be cleared from the main compartment without cycling down the printing system, thereby allowing for continued productivity.

Specifically, all of the embodiments can comprise a first module. The first module can comprise a support frame having a first side and a second side opposite the first side. The frame can be divided into at least two discrete compartments. The first compartment can comprise a main sheet transport path and a sheet processing device (e.g., a sheet stacking device or a sheet feeding device). The main sheet transport path can extend essentially horizontally between a first sheet input port on a first side of the frame and a first sheet output port on the second side of the frame. The sheet processing device can be connected to the main sheet transport path for either receiving sheets from the path (e.g., in the case of a sheet stacking device) or feeding sheets into the path (e.g., in the case of a sheet feeding device). Additionally, one or more print media sheet jam detection sensors can be positioned throughout the first compartment adjacent to the main sheet transport path and, optionally, adjacent to the sheet processing device for detecting print media sheet jams contained therein. The second compartment can be positioned, for example, above the first compartment and can comprise a bypass path extending essentially horizontally between a second sheet input port on the first side of the frame and a second sheet output port on the second side of the frame.

All of the embodiments can further comprise a second module. The second module can be connected in series with the first module. Specifically, the second module can be positioned upstream of the first module and immediately adjacent to the first side of the first module. The second module can selectively feed sheets to either the first input port (and, thereby to the main sheet transport path) or the second input port (and, thereby to the bypass path) of the first module.

For example, in one embodiment, the first module can comprise a first stacker module comprising a sheet stacking device. The sheet stacking device can be connected to the main sheet transport path and can receive and stack sheets received from the main sheet transport path. In this embodiment, the second module can comprise an interface module positioned upstream of the first stacker module and, more particularly, between the first stacker module and an additional module (e.g., either a printing module or another stacker module). The interface module can receive sheets from the additional module and can selectively feed those sheets to either the first input port (and, thereby the main sheet transport path) or the second input port (and, thereby the bypass path).

In other embodiments, the first module can comprise a first feeder module comprising at least one sheet feeding device. The sheet feeding device can be connected to both the main sheet transport path and to a corresponding bypass path and can selectively feed sheets to either the main sheet transport path or to the corresponding bypass path. In these embodiments, the second module can comprise a second feeder module positioned upstream of the first feeder module. The second feeder module can selectively feed sheets to either the first input port (and, thereby the main sheet transport path) or the second input port (and, thereby to the corresponding bypass path) of the first feeder module. These embodiments can further comprise an interface module positioned downstream of the first feeder module. The interface module can receive sheets from both the first and second output ports of the first feeder module and can merge those sheets into a single stream (e.g., for subsequent processing).

All of the embodiments can further comprise a controller operatively connected to both the first module and the second module so as to control movement of sheets into and through the main sheet transport path and the bypass path(s) of the first module. Specifically, the controller can perform at least the following operations. The controller can cause at least one gate in the second module to direct sheets into the first input port of the first module such that sheets are transported through the main sheet transport path. In the event of a print media sheet jam in the main compartment of the first module, the controller can receive a sheet jam detection signal from any one or more of the sheet jam detection sensor(s). Then (i.e., after receiving a sheet jam detection signal), the controller can cause the gate(s) in the second module to redirect the sheets into the second input port(s) of the first module such that the sheets are transported through the bypass path(s) rather than the main sheet transport path. During operation of the bypass path(s) in the first module (i.e., as sheets are transported through the bypass path in the second compartment), a user can access the first compartment through the access panel and can locate and correct the jam as detected by the jam detection sensor(s).

More particularly, disclosed herein is an embodiment of a modular printing system incorporating at least one stacker module with a main sheet transport path, a sheet stacking device and a bypass path.

Specifically, this embodiment can comprise a first stacker module. The first stacker module can comprise a support frame having a first side and a second side opposite the first side. The support frame can be divided into at least two discrete compartments. The first compartment can comprise a main sheet transport path and a sheet stacking device, each of which are accessible through an access panel. The main sheet transport path can extend essentially horizontally between a first sheet input port on the first side of the frame and a first sheet output port on the second side of the frame. The sheet stacking device can be connected to the main sheet transport path for receiving sheets from the path. Additionally, one or more print media sheet jam detection sensors can be positioned throughout the first compartment adjacent to the main sheet transport path and adjacent to the sheet stacking device for detecting print media sheet jams contained therein. The second compartment can be positioned, for example, above the first compartment and can comprise a bypass path extending essentially horizontally between a second sheet input port on the first side of the frame and a second sheet output port on the second side of the frame.

This embodiment can further comprise one or more interface modules. For example, a first interface module can be connected in series with the first stacker module. Specifically, the first interface module can be positioned upstream of the first stacker module and immediately adjacent to the first side of the first stacker module. It can further be positioned between the first stacker module and an additional module (e.g., a printing module, other device having a similar output port as a printing module, or another stacking module). The first interface module can comprise one or more input ports, as necessary, for receiving sheets from the additional module and can further comprise multiple output ports for selectively feeding sheets to either the first input port or the second input port of the first stacker module. Optionally, a portion of the main sheet transport path connected to the first input port in the first stacker module can be selectively movable in order to align one of multiple first input ports of the first stacker module with one of the multiple output ports on the first interface module.

In operation, the first interface module can selectively feed sheets, which are received from the additional module (e.g., a printing module, other device having a similar output port as a printing module, or another stacker module) either out one of its multiple output ports and into the first input port of the first stacker module (and, thereby into the main sheet transport path) or out a different one of its multiple output ports and into the second input port of the first stacker module (and, thereby into the bypass path).

This embodiment can further comprise a controller operatively connected to the first stacker module and to the first interface module so as to control movement of sheets through the first interface module and into and through the main sheet transport path and the bypass path of the first stacker module. Specifically, the controller can perform at least the following operations. The controller can cause a first gate in the first interface module to direct sheets, which were received from the additional module (e.g., from a printing module, other device having a similar output port as a printing module, or another stacker module) into the first input port of the first stacker module such that the sheets are transported through the main sheet transport path of the first stacker module. The controller can further cause a second gate in the first stacker module adjacent to the main sheet transport path to selectively direct any sheets being transported through the main sheet transport path either into the first output port (i.e., out of the first stacking module) or into the sheet stacking device to be stacked. Additionally, in the event of a print media sheet jam in the first compartment, the controller can receive a sheet jam detection signal from any one or more of the sheet jam detection sensor(s) in the first compartment. Then (i.e., after receiving the sheet jam detection signal(s)), the controller can cause the first gate in the first interface module to redirect sheets into the second input port of the first stacker module such that the sheets are transported through the bypass path rather than the main sheet transport path.

The second compartment of the first stacker module can be located above the first compartment in the frame, as mentioned above. Thus, the bypass path can be positioned above the main sheet transport path. Additionally, the frame and, particularly, the second compartment in the frame can have a top surface with an additional output port. The bypass path in the second compartment can extend to the second output port on the second side of the frame, as mentioned above, and can further branch off to the additional output port. A third gate, controlled by the controller, can be positioned in the second compartment adjacent to the bypass path and, particularly, adjacent to the location where the bypass path branches and can selectively direct sheets either out the second output port on the second side of the frame or out the additional output port on the top surface of the frame.

For example, sheets directed out the second output port on the second side of the frame can, for example, pass to a second interface module connected in series to a second stacker module. This second stacker module can be essentially identical to the first stacker module, discussed above, and the second interface module can be configured to receive sheets from both the first output port and the second output port of the first stacker module and to feed such sheets to either the first input port or the second input port of the second stacker module, as directed by the controller. Alternatively, sheets directed out the additional output port on the top surface of the frame can, for example, pass into an output tray.

During operation of the bypass path (i.e., as sheets are transported through the bypass path in the second compartment of the first stacker module), a user can access the first compartment through the access panel and can locate and correct the jam as detected by the jam detection sensor(s). Thus, this embodiment allows for continued productivity even in the event of a print media sheet jam.

Also disclosed herein are embodiments of a modular printing system incorporating a feeder module with a main sheet transport path, at least one feeder device and a discrete bypass path associated with each feeder device.

Specifically, each of these embodiments can comprise a first feeder module. In one embodiment, the first feeder module can comprise a support frame having a first side and a second side opposite the first side. The frame can be divided into at least two discrete compartments. The first compartment can comprise a main sheet transport path and a sheet feeding device, each of which are accessible through an access panel. The main sheet transport path can extend between a first sheet input port on the first side of the frame and a first sheet output port on the second side of the frame. Additionally, one or more print media sheet jam detection sensor(s) can be positioned throughout the first compartment adjacent to the main sheet transport path and, optionally, adjacent to the sheet feeding device for detecting print media sheet jams contained therein. The second compartment can be positioned, for example, above the first compartment and can comprise a bypass path extending essentially horizontally between a second sheet input port on the first side of the frame and a second sheet output port on the second side of the frame. In this embodiment, the sheet feeding device contained in the first compartment can be connected to the main sheet transport path and can further be connected to the bypass path through an opening between the first and second compartments. Thus, sheets from the sheet feeding device can be selectively fed to either the main sheet transport path or the bypass path.

Additionally, in this embodiment, a controller can be operatively connected to the first feeder module so as to control movement of sheets into and through the main sheet transport path and the bypass path. Specifically, the controller can perform at least the following operations. The controller can cause a gate in the first feeder module to direct sheets from the sheet feeding device into the main sheet transport path such that the sheets are transported through the main sheet transport path and out the first output port on the second side of the frame. In the event of a print media sheet jam in the first compartment, the controller can receive a sheet jam detection signal from any one or more of the sheet jam detection sensor(s) in the first compartment. Then (i.e., after receiving the sheet jam detection signal(s)), the controller can cause the gate to direct the sheets from the sheet feeding device into the bypass path such that the sheets are transported through the bypass path and out the second sheet output port rather than out the first sheet output port of the main sheet transport path.

This embodiment can further comprise a second feeder module connected in series with the first feeder module. Specifically, the second feeder module can be positioned upstream of the first feeder module and adjacent to the first side of the first feeder module. The second feeder module can be configured such that it is essentially identical to the first feeder module and can feed additional sheets selectively into either the first input port of the first feeder module (and, thereby into the main sheet transport path) or the second input port of the first feeder module (and, thereby into the bypass path). In this case, the controller can further be operatively connected to the second feeder module so as to control movement of the additional sheets from the second feeder module into the main sheet transport and bypass paths of the first feeder module. Specifically, the controller can further perform the following operations. The controller can cause an additional gate in the second feeder module to direct the additional sheets into the first input port of the first feeder module such that the additional sheets are transported by the main sheet transport path to the first output port of the first feeder module. After receiving one or more sheet jam detection signals from the sheet jam detection sensor(s) in the first compartment of the first feeder module, the controller can cause the additional gate in the second feeder module to direct the additional sheets from the second feeder module into the second input port of the first feeder module such that the additional sheets are transported by the bypass path through the first feeder module rather than by the main sheet transport path.

This embodiment can further comprise an interface module also connected in series with the first feeder module. Specifically, the interface module can be positioned downstream of the first feeder module and, particularly, adjacent to the second side of the first feeder module. The interface module can merge, into a single stream of sheets, all sheets received from the first output port (i.e., from the main sheet transport path) and the second output port (i.e., the bypass path) of the first feeder module for subsequent processing (e.g., by a printing module).

During operation of the bypass path (i.e., as sheets are transported through the bypass path in the second compartment of the first feeder module), a user can access the first compartment through the access panel and can locate and correct the jam as detected by the jam detection sensor(s). Thus, this embodiment allows for continued productivity even in the event of a print media sheet jam.

In another embodiment, the first feeder module can similarly comprise a frame having a first side and a second side opposite the first side. The frame can be divided into multiple discrete compartments: a first compartment (i.e., a main compartment) and multiple second compartments (i.e., bypass path compartments). The first compartment can comprise a main sheet transport path and multiple sheet feeding devices (e.g., an upper sheet feeding device and a lower sheet feeding device), each of which are accessible through one or more access panels. The main sheet transport path can extend between a first sheet input port on the first side of the frame and a first sheet output port on the second side of the frame. Additionally, one or more print media sheet jam detection sensor(s) can be positioned throughout the first compartment adjacent to the main sheet transport path and, optionally, adjacent to the sheet feeding devices for detecting print media sheet jams contained therein.

The second or bypass path compartments can, for example, be positioned both above and below the first compartment. Specifically, a second compartment above the first compartment can comprise an upper bypass path extending between a second sheet input port on the first side of the frame and a second sheet output port on the second side of the frame. Similarly, a second compartment below the first compartment can comprise a lower bypass path extending between a third sheet input port on the first side of the frame and a third sheet output port on the second side of the frame. In this embodiment, the upper sheet feeding device contained in the first compartment can be connected to both the main sheet transport path and the upper bypass path through an opening between the first compartment and the second compartment above the first compartment. Thus, sheets from the upper sheet feeding device can be selectively fed to either the main sheet transport path or the upper bypass path. Similarly, in this embodiment, the lower sheet feeding device contained in the first compartment can be connected to both the main sheet transport path and the lower bypass path through an opening between the first compartment and the second compartment below the first compartment. Thus, sheets from the lower sheet feeding device can be selectively fed to either the main sheet transport path or the lower bypass path.

In this embodiment, a controller can be operatively connected to the first feeder module so as to control movement of sheets into and through the main sheet transport path and the upper and lower bypass paths. Specifically, the controller can perform at least the following operations. The controller can cause a first gate to direct first sheets from the upper sheet feeding device into the main sheet transport path such that the first sheets are transported through the main sheet transport path and/or can cause a second gate to direct second sheets from the lower sheet feeding device into the main sheet transport path such that the second sheets are transported through the main sheet transport path. In the event of a print media sheet jam in the first compartment, the controller can receive a sheet jam detection signal from any one or more of the sheet jam detection sensor(s) in the first compartment. Then, (i.e., after receiving the sheet jam detection signal(s)), the controller can cause the first gate to direct the first sheets from the upper sheet feeding device into the upper bypass path such that the first sheets are transported through the upper bypass path and out the second sheet output port rather than the first sheet output port of the main sheet transport path and/or can cause the second gate to direct the second sheets from the lower sheet feeding device into the lower bypass path such that the second sheets are transported through the lower bypass path and out the third sheet output port rather than the first sheet output port of the main sheet transport path.

This embodiment can further comprise a second feeder module connected in series with the first feeder module. Specifically, the second feeder module can be positioned upstream of the first feeder module and adjacent to the first side of the first feeder module. The second feeder module can be configured such that it is essentially identical to the first feeder module and can feed additional sheets selectively into the first input port of the first feeder module (and, thereby the main sheet transport path), the second input port of the first feeder module (and, thereby the upper bypass path) or the third input port of the first feeder module (and, thereby the lower bypass path).

In this case, the controller can further be operatively connected to the second feeder module so as to control movement of the additional sheets from the second feeder module into the main sheet transport path and the upper and lower bypass paths of the first feeder module. Specifically, the controller can further perform at least the following operations. The controller can cause additional gates in the second feeder module to direct additional sheets (e.g., from upper and lower feeding devices in the second feeder module) into the first input port of the first feeder module such that the additional sheets are transported through the first feeder module by the main sheet transport path to the first output port. After receiving one or more sheet jam detection signals from the sheet jam detection sensor(s) in the first compartment of the first module, the controller can cause the additional gates in the second feeder module to direct the additional sheets from the second feeder module into the second or third input ports of the first feeder module such that the additional sheets are transported through the first feeder module by the upper and lower bypass paths to the second and third output ports, respectively, rather than by the main sheet transport path.

This embodiment can further comprise an interface module also connected in series with the first feeder module. Specifically, the interface module can be positioned downstream of the first feeder module and, particularly, adjacent to the second side of the first feeder module. The interface module can merge, into a single stream of sheets, all sheets received from the first output port (i.e., from the main sheet transport path), the second output port (i.e., the upper bypass path) and the third output port (i.e., the lower bypass path) of the first feeder module.

During operation of the upper and lower bypass paths (i.e., as sheets are transported through the upper and/or the lower bypass paths in the second compartments of the first feeder module), a user can access the first compartment through the access panel(s) and can locate and correct the jam as detected by the jam detection sensor(s). Thus, this embodiment allows for continued productivity even in the event of a print media sheet jam.

These and other features are described in, or are apparent from, the following detailed description.

BRIEF DESCRIPTION OF THE DRAWINGS

Various exemplary embodiments of systems and methods are described in detail below, with reference to the attached drawing figures, in which.

DETAILED DESCRIPTION

Figure 1:
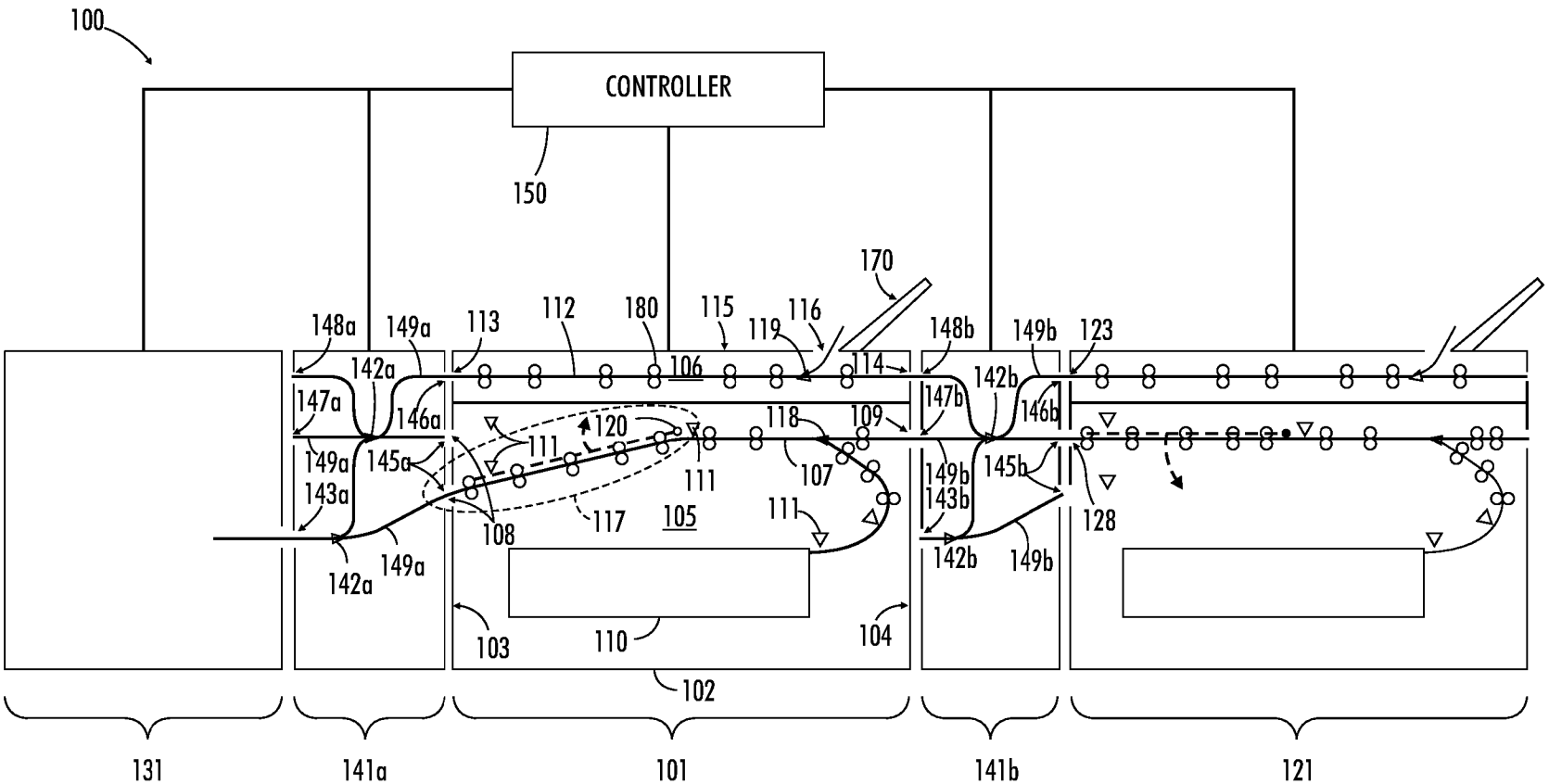
FIG. 1 is a schematic diagram illustrating an embodiment of a modular printing system having multiple series-connected stacker modules, each incorporating a bypass path.

The embodiments of the invention and the various features and advantageous details thereof are explained more fully with reference to the non-limiting embodiments that are illustrated in the accompanying drawings and detailed in the following description.

As discussed above, modularity in printing systems, such as electrostatographic or other types of printing systems, is known. For example, each of the following patent documents assigned to Xerox Corporation of Norwalk, Conn., USA, and incorporated herein by reference in their entirety disclose modular printing systems: U.S. patent application Ser. No. 12/211,853 of Bober et al., filed on Sep. 17, 2008; U.S. patent application Ser. No. 12/331,768 of Mandel et al., filed on Dec. 10, 2008; U.S. Patent Publication No. 2008/0265483 of Hermann, published on Oct. 30, 2008; U.S. Patent Application Publication No. 2006/0214352 of Clark, published on Sep. 28, 2006; U.S. Pat. No. 6,748,186 of Skrainar et al., issued on Jun. 8, 2004; U.S. Pat. No. 7,280,771 of Mandel et al., issued on Oct. 9, 2007; and U.S. Pat. No. 7,280,781 of Willis, issued on Oct. 9, 2007. Each of these modular printing systems comprises multiple modules (i.e., discrete interchangeable units), each of which comprises one or more functional components (e.g., sheet feeders, printing engines, sheet inverters, sheet buffers, sheet finishers, sheet stackers, etc.) contained within a supporting frame and housing (i.e., within a cabinet).

Oftentimes multiple modules with essentially the same functional component (i.e., redundant modules) will be connected in series within a single modular printing system to provide additional capacity (e.g., printing capacity, stacking capacity, feeding capacity, etc.). For example, multiple printing engine modules are connected in series in tightly integrated serial printing (TISP) architectures (e.g., see U.S. Pat. No. 7,280,771 incorporated by reference above) to provide both single color (i.e., monochrome) and/or multi-color printing. Additionally, multiple stacker modules can be connected in series downstream from a printing module to ensure sufficient sheet storage capacity at output (e.g., if one stacker becomes full, the next stacker in the series will be used, see U.S. Patent Publication No. 2008/0265483 incorporated by reference above). Finally, multiple feeder modules can be connected in series upstream from a printing module to ensure that a sufficient sheet feeding capacity and/or to ensure that a desired sheet feeder rate is achieved (e.g., see U.S. Patent Publication No. 2006/0214352 incorporated by reference above). Unfortunately, modular printing systems such as those described above incorporating series-connected redundant modules and, particularly, incorporating series connected stacker and/or feeder modules, must cycle down completely in order to clear a print media sheet jam (e.g., a paper jam).

In view of the foregoing, disclosed herein are embodiments of a modular printing system with one or more modules having one or more bypass paths. Specifically, embodiments disclosed herein comprise a modular printing system with a module (e.g., a stacker or feeder module) having a main compartment and at least one additional compartment. Contained within the main compartment is a main sheet transport path and a functional component (e.g., a sheet stacking device or a sheet feeding device) connected to the main sheet transport path. Contained with the additional compartment is a bypass path. The bypass path allows sheets to be routed through the module in the event of a print media sheet jam in the main sheet transport path. Because the bypass path is contained within a separate compartment, the jam can be cleared from the main compartment without cycling down the printing system, thereby allowing for continued productivity.

Figure 2:
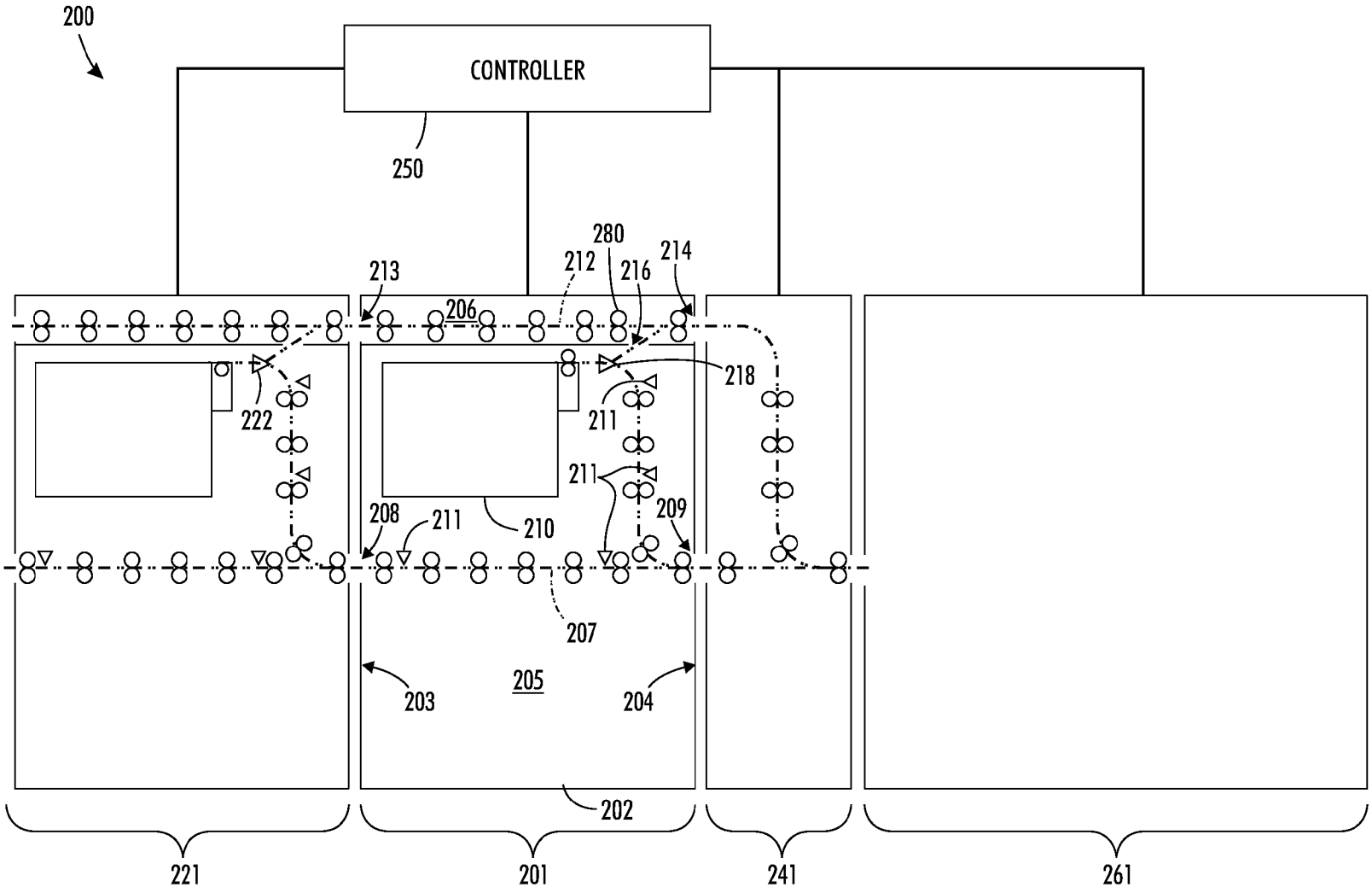
FIG. 2 is a schematic diagram illustrating an embodiment of a modular printing system having multiple series-connected feeder modules, each incorporating a bypass path.
Figure 3:
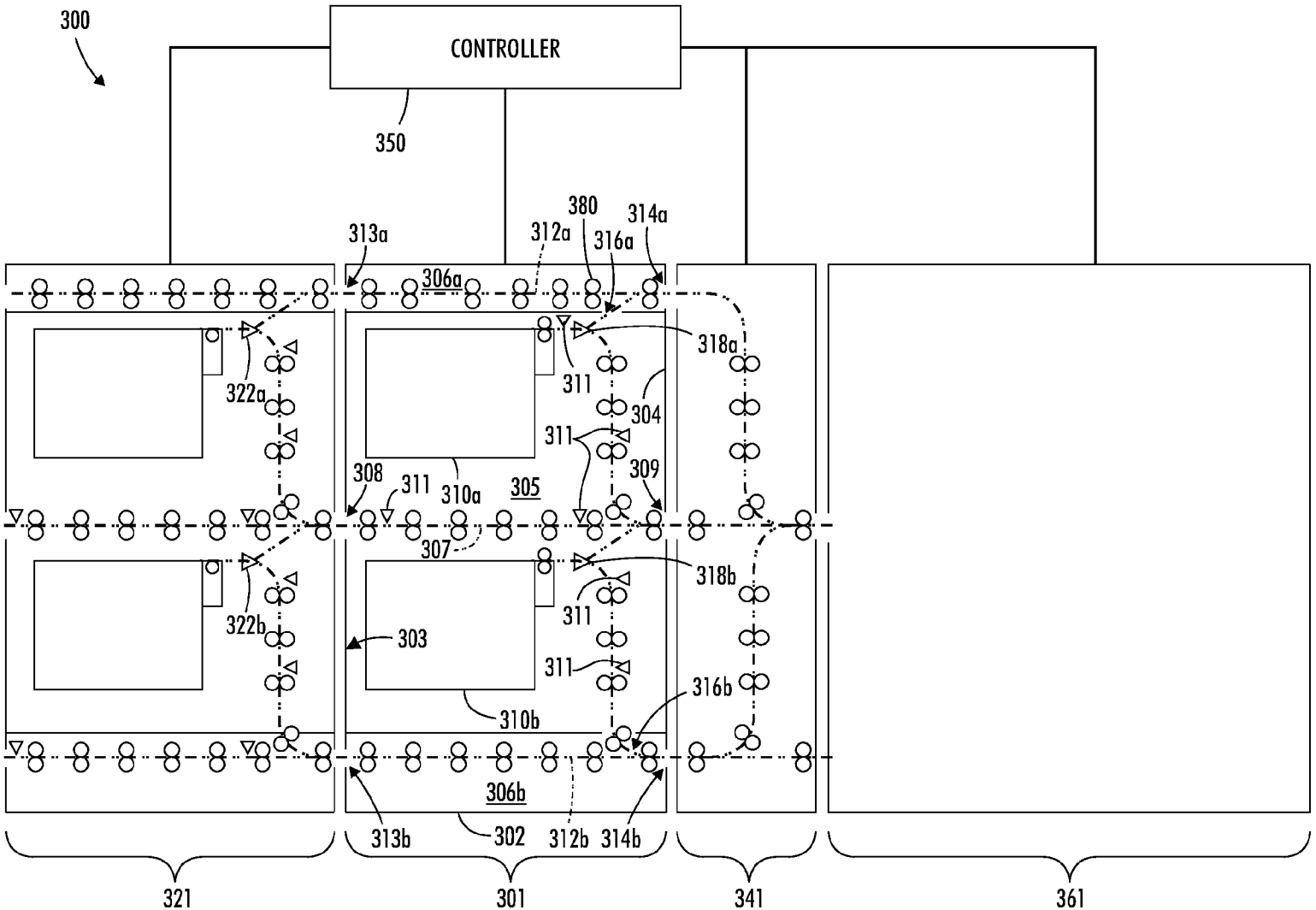
FIG. 3 is a schematic diagram illustrating an embodiment of a module printing system having multiple series-connected feeder modules, each incorporating multiple bypass paths.

Specifically, FIGS. 1, 2 and 3 illustrate three different embodiments of a modular printing system 100, 200, 300. Each of these embodiments 100, 200, 300 can comprise a first module 101, 201, 301. The first module 101, 201, 301 can comprise a support frame 102, 202, 302 having a first side 103, 203, 303 and a second side 104, 204, 304 opposite the first side 103, 203, 303. The frame 102, 202, 302 can be divided into at least two discrete compartments: a first compartment 105, 205, 305 (i.e., the main compartment) and at least one second compartment 106, 206, 306*a-b* (i.e., at least one bypass path compartment). The first compartment 105, 205, 305 can comprise a main sheet transport path 107, 207, 307 and at least one sheet processing device 110, 210, 310*a-b* (e.g., at least one sheet stacking device or sheet feeding device). The main sheet transport path 107, 207, 307 can extend essentially horizontally between a first sheet input port 108, 208, 308 on one side of the frame 102, 202, 302 (i.e., the first side 103, 203, 303) and a first sheet output port 109, 209, 309 on the opposite side of the frame 102, 202, 302 (i.e., the second side 104, 204, 304). Each sheet processing device 110, 210, 310*a-b* can be connected to the main sheet transport path 107, 207, 307 for either receiving sheets from the path (e.g., in the case of a sheet stacking device 110, as shown particularly in FIG. 1) or feeding sheets into the path (e.g., in the case of a sheet feeding device 210 or 310*a-b* as shown particularly in FIGS. 2-3). Additionally, one or more print media sheet jam detection sensors 111, 211, 311 can be positioned throughout the first compartment 105, 205, 305 adjacent to the main sheet transport path 107, 207, 307 and, optionally, adjacent to the sheet processing device(s) 110, 210, 310*a-b* for detecting print media sheet jams contained therein. As shown particularly in FIGS. 1-2, the second compartment 106, 206 (i.e., the bypass path compartment) can be positioned, for example, above the first compartment 105, 205. Alternatively, as shown particularly FIG. 3, one second compartment 306*a* can be positioned above the first compartment 305 and another 306*b* can be positioned below the first compartment 305. Such second compartments 106, 206, 306*a-b* can each comprise a bypass path 112, 212, 312*a-b* extending essentially horizontally between a second sheet input port 113, 213, 313*a-b* on one side of the frame 102, 202, 302 (i.e., the first side 103, 203, 303) and a second sheet output port 114, 214, 314*a-b* on the opposite side of the frame 102, 202, 302 (i.e., the second side 104, 204, 304).

Each of these embodiments 100, 200, 300 can further comprise a second module 141*a*, 221, 321. The second module 141*a*, 221, 321 can be connected in series with the first module 101, 201, 301. Specifically, the second module 141*a*, 221, 321 can be positioned upstream of the first module 101, 201, 301 (i.e., preceding the first module 101, 201, 301 in the series connection) and immediately adjacent to the first side 103, 203, 303 of the first module 101, 201, 301. The second module 141*a*, 221, 321 can selectively feed sheets (i.e., can be configured, for example, with one or more gates to selectively feed sheets) to either the first input port 108, 208, 308 (and, thereby to the main sheet transport path 107, 207, 307) or the second input port 113, 213, 313*a* or 313*b* (and, thereby to the bypass path 112, 212, 312*a* or 312*b*) of the first module 101, 201, 301.

For example, referring to FIG. 1, in the modular printing system embodiment 100, the first module 101 can comprise a first stacker module and the sheet processing device 110 can comprise sheet stacking device. The sheet stacking device 110 can be connected to the main sheet transport path 107 and can receive and stack sheets (i.e., can be configured to receive and stack sheets) received from the main sheet transport path 107. In this embodiment, the second module 141*a* can comprise an interface module positioned upstream of the first stacker module 101 and, more particularly, between the first stacker module 101 and an additional module 131 (e.g., a printing module, another device having a similar output port as a printing module, or another stacker module). The interface module 141*a* can receive sheets from the additional module 131 and can selectively feed those sheets (i.e., can be configured, for example, with one or more gates 142*a* to selectively feed those sheets) to either the first input port 108 (and, thereby the main sheet transport path 107) or the second input port 113 (and, thereby the bypass path 112).

Referring to FIGS. 2 and 3, in the modular printing system embodiments 200 and 300, the first module 201, 301 can comprise a first feeder module comprising at least one sheet feeding device (e.g., see feeding device 210 of FIG. 2 and upper and lower feeding devices 310*a-b* of FIG. 3). Each sheet feeding device 210, 310*a-b* can be connected to both the main sheet transport path 207, 307 and to a corresponding bypass path 212, 312*a-b* and can selectively feed sheets (i.e., can be configured, for example, with one or more gates 218, 318*a-b* to selectively feed sheets) to either the main sheet transport path 207, 307 or to the corresponding bypass path 212, 312*a-b*. In these embodiments, the second module 221, 321 can comprise a second feeder module positioned upstream of the first feeder module 201, 301. The second feeder module 221, 321 can selectively feed sheets (i.e., can be configured, for example, with one or more gates 222, 322*a-b* to selectively feed sheets) to either the first input port 208, 308 (and, thereby the main sheet transport path 207, 307) or the second input port(s) 213, 313*a-b* (and, thereby to the corresponding bypass path 212, 312*a-b*) of the first feeder module 201, 301. These embodiments can further comprise an interface module 241, 341 positioned downstream of the first feeder module 201, 301 (i.e., adjacent to the second side 204, 304 of the first feeder module 201, 301). The interface module 241, 341 can receive sheets (i.e., can be adapted to receive sheets) from both the first and second output ports of the first feeder module 201, 301 (i.e., 209 and 214 of FIGS. 2 and 309 and 314*a-b* of FIG. 3) and can merge those sheets (i.e., can be adapted to merge those sheets) into a single stream for subsequent processing (e.g., by a printing module 261, 361).

The embodiments 100 of FIG. 1, 200 of FIGS. 2 and 300 of FIG. 3, can each further comprise a controller 150, 250, 350 operatively connected to both the first module 101, 201, 301 and the second module 141*a*, 221, 321 so as to control movement of sheets into and through the main sheet transport path 107, 207, 307 and the bypass path(s) 112, 212, 312*a-b* of the first module 101, 201, 301. Specifically, the controller 150, 250, 350 can perform (i.e., can be adapted to perform, programmed to perform, etc.) at least the following operations. The controller 150, 250, 350 can cause at least one gate 142*a*, 222, 322*a-b* in the second module 141*a*, 221, 321 to direct sheets into the first input port 108, 208, 308 of the first module 101, 201, 301 such that sheets are transported through the main sheet transport path 107, 207, 307. In the event of a print media sheet jam in the main compartment 105, 205, 305 of the first module 101, 201, 301, the controller 150, 250, 350 can receive a sheet jam detection signal from any one or more of the sheet jam detection sensor(s) 111, 211, 311. Then (i.e., after receiving a sheet jam detection signal), the controller 150, 250, 350 can cause the gate(s) 142*a*, 222, 322*a-b* in the second module 141*a*, 221, 321 to redirect the sheets into the second input port(s) 113, 213, 313*a-b* of the first module 101, 201, 301 such that the sheets are transported through the bypass path(s) 112, 212, 312*a-b* rather than the main sheet transport path 107, 207, 307. During operation of the bypass path(s) 112, 212, 312*a-b* in the first module 101, 201, 301 (i.e., as sheets are transported through the bypass path(s) 112, 212, 312*a-b* in the second compartment(s) 106, 206, 306*a-b*), a user can access the first compartment 105, 205, 305 through the access panel and can locate and correct the jam as detected by the jam detection sensor(s) 111, 211, 311. Thus, the embodiments disclosed herein allow for continued productivity even in the event of a print media sheet jam.

More particularly, referring to FIG. 1, disclosed herein is an embodiment of a modular printing system 100 incorporating at least one stacker module 101 with a main sheet transport path 107, a sheet stacking device 110 and a bypass path 112.

Specifically, this embodiment can comprise a first stacker module 101. The first stacker module 101 can comprise a support frame 102 having a first side 103 and a second side 104 opposite the first side. The support frame 102 can be divided into at least two discrete compartments: a first compartment 105 (i.e., a main compartment) and a second compartment 106 (i.e., a bypass path compartment). The first compartment 105 can comprise a main sheet transport path 107 and a sheet stacking device 110, each of which are accessible through an access panel. The main sheet transport path can extend essentially horizontally between a first sheet input port 108 on one side of the frame 102 (i.e., on the first side 103) and a first sheet output port 109 on the opposite side of the frame 102 (i.e., on the second side 104). The sheet stacking device 110 can be connected to the main sheet transport path 107 for receiving sheets from the path. Additionally, one or more print media sheet jam detection sensors 111 can be positioned throughout the first compartment 105 adjacent to the main sheet transport path 107 and adjacent to the sheet stacking device 110 for detecting print media sheet jams contained therein. The second compartment 106 can be positioned, for example, above the first compartment 105 and can comprise a bypass path 112 extending essentially horizontally between a second sheet input port 113 on one side of the frame 102 (i.e., the first side 103) and a second sheet output port 114 on the opposite side of the frame 102 (i.e., the second side 104).

This embodiment can further comprise one or more interface modules 141*a*, 141*b*. For example, a first interface module 141*a* can be connected in series with the first stacker module 101. Specifically, the first interface module 141*a* can be positioned upstream of the first stacker module 101 (i.e., preceding the first stacker module 101 in the series connection) and immediately adjacent to the first side 103 of the first stacker module 101. It can further be positioned between the first stacker module 101 and an additional module 131 (e.g., a printing module, another device having a similar output port as a printing module, another stacker module, etc.). The first interface module 141*a* can comprise one or more input ports (e.g., see sheet input ports 143*a*, 147*a*, 148*a*) for receiving sheets from the additional module 131. It should be noted that the interface module 141*a* can comprise multiple different sheet input ports positioned, for example, at different heights so as to allow the same interface module to receive sheets from different types of modules (e.g., a printing module or another stacker module). The first interface module 141*a* can further comprise multiple output ports (e.g., see sheet output ports 145*a*, 146*a*) and multiple linked sheet transport paths 149*a* for selectively feeding sheets to either the first input port 108 or the second input port 113, respectively, of the first stacker module 101.

Optionally, in the first stacker module 101, a portion 117 of the main sheet transport path 107 connected to the first input port 108 can be selectively movable in order to align one of multiple first input ports 108 of the first stacker module 101 with one of the multiple output ports 145*a* on the first interface module 141*a*. Specifically, the portion 117 of sheet transport path 107 can be configured so as to pivot in an essentially longitudinal direction about an axis 120. This allows the sheet transport path 107 to connect to one of multiple input ports 108 on the frame 102 and, thereby to accommodate different interface modules (e.g., see interface modules 141*a* and 141*b*) with output ports at different heights. Movement of the portion 117 of the main sheet transport path 107 can be performed manually using known mechanical hardware such as brackets, baffles and screws.

In operation, the first interface module 141*a* can selectively feed sheets (i.e., can be configured with one or more gates 142*a* to selectively feed sheets), which are received from the additional module 131 (e.g., a printing module or other device having a similar output port as a printing module) either out one of its output ports 145*a* and into a first input port 108 of the first stacker module 101 (and, thereby into the main sheet transport path 107) or out a different output port 146*a* and into the second input port 113 of the first stacker module 101 (and, thereby into the bypass path 112).

These embodiments can further comprise a controller 150 operatively connected to the first stacker module 101 and to the first interface module 141*a* so as to control movement of sheets through the first interface module 141*a* and into and through the main sheet transport path 107 and the bypass path 112 of the first stacker module 101. Specifically, the controller 150 can perform (i.e., can be adapted to perform, programmed to perform, etc.) at least the following operations. The controller 150 can cause a first gate or gates 142*a* in the first interface module 141*a* to direct sheets, which were received from the additional module 131 (e.g., from a printing module or other device having a similar output port as a printing module) into a first input port 108 of the first stacker module 101 such that the sheets are transported through the main sheet transport path 107 of the first stacker module 101. The controller 150 can further cause a second gate 118 in the first stacker module 101 adjacent to the main sheet transport path 107 to selectively direct any sheets being transported through the main sheet transport path 107 either into the first output port 109 (i.e., out of the first stacking module 101) or into the sheet stacking device 110 to be stacked. Additionally, in the event of a print media sheet jam in the first compartment 105, the controller 150 can receive a sheet jam detection signal from any one or more of the sheet jam detection sensor(s) 111 in the first compartment 105. Then (i.e., after receiving the sheet jam detection signal(s)), the controller 150 can cause the first gate(s) 142*a* in the first interface module 141*a* to redirect sheets into the second input port 113 of the first stacker module 101 such that the sheets are transported through the bypass path 112 rather than the main sheet transport path 107.

The second compartment 106 of the first stacker module 101 can be located above the first compartment 105 in the frame 102, as mentioned above. Thus, the bypass path 112 can be positioned above the main sheet transport path 107. Additionally, the frame 102 and, particularly, the second compartment 106 in the frame 102 can have a top surface 115 with an additional output port 116. The bypass path 112 in the second compartment 106 can extend to the second output port 114 on the second side 104 of the frame 102, as mentioned above, and can further branch off to the additional output port 116. A third gate 119, controlled by the controller 150, can be positioned in the second compartment 106 adjacent to the bypass path 112 and, particularly, adjacent to the location where the bypass path 112 branches to the different output ports 114 and 116 and can selectively direct sheets (i.e., can be configured with gate 119 to selectively direct sheets) either out the second output port 114 on the second side 104 of the frame 102 or out the additional output port 116 on the top surface 115 of the frame 102.

For example, sheets directed out the second output port 114 on the second side 104 of the frame 102 can, for example, pass to a second interface module 141*b* connected in series to a second stacker module 121. The second interface module 141*b* can be essentially identical to the first interface module 141*a*, as described above. That is, the second interface module 141*b* can comprise multiple different sheet input ports (e.g., 143*b*, 147*b*, 148*b*) positioned, for example, at different heights. The second interface module 141*b* can further comprise multiple output ports (e.g., ports 145*b*, 146*b*) and multiple linked sheet transport paths 149*b*) for selectively feeding sheets out one of the output ports 145*b*, 146*b*. The second stacker module 121 can be essentially identical to the first stacker module 101, discussed above, and the second interface module 141*b* can be configured to receive sheets from both the first output port 109 and the second output port 114 of the first stacker module 101 and to feed, by means of gate 142*b*, such sheets from the first input port 147*b* or the second input port 148*b* of the interface module 141*b* through the first output port 145*b* to either the first input port 128 or through the second output port 146*b* to the second input port 123 of the second stacker module 121, as directed by the controller 150. Alternatively, sheets directed out the additional output port 116 on the top surface 115 of the frame 102 can, for example, pass into an output tray 170.

During operation of the bypass path 112 (i.e., as sheets are transported through the bypass path 112 in the second compartment 106 of the first stacker module 101), a user can access the first compartment 105 through the access panel and can locate and correct the jam as detected by the jam detection sensor(s) 111. Thus, this embodiment allows for continued productivity even in the event of a print media sheet jam.

Also referring to FIGS. 2 and 3 disclosed herein are embodiments 200 and 300, respectively, of a modular printing system. Each of these embodiments incorporate at least one feeder module having a main sheet transport path, at least one feeder device, and a discrete bypass path associated with each feeder device.

Referring to the embodiment 200 in FIG. 2, the first feeder module 201 can comprise a support frame 202 having a first side 203 and a second side 204 opposite the first side 203. The frame 202 can be divided into at least two discrete compartments: a first compartment 205 (i.e., a main compartment) and a second compartment 206 (i.e., a bypass path compartment). The first compartment 205 can comprise a main sheet transport path 207 and a sheet feeding device 210, each of which are accessible through an access panel. The main sheet transport path 207 can extend between a first sheet input port 208 on one side of the frame 202 (e.g., the first side 203) and a first sheet output port 209 on the opposite side of the frame 202 (e.g., the second side 204). Additionally, one or more print media sheet jam detection sensors 211 can be positioned throughout the first compartment 205 adjacent to the main sheet transport path 207 and, optionally, adjacent to the sheet feeding device 210 for detecting print media sheet jams contained therein. The second compartment 206 can be positioned, for example, above the first compartment 205 and can comprise a bypass path 212 extending essentially horizontally between a second sheet input port 213 on one side of the frame 202 (i.e., the first side 203) and a second sheet output port 214 on the opposite side of the frame 202 (i.e., the second side 204). In this embodiment, the sheet feeding device 210 contained in the first compartment 205 can be connected to the main sheet transport path 207 and can further be connected to the bypass path 212 through an opening 216 between the first and second compartments 205, 206. Thus, sheets from the sheet feeding device 210 can be selectively fed to either the main sheet transport path 207 or the bypass path 212.

Additionally, in this embodiment, a controller 250 can be operatively connected to the first feeder module 201 so as to control movement of sheets into and through the main sheet transport path 207 and the bypass path 212. Specifically, the controller 250 can perform (i.e., can be adapted to perform, programmed to perform, etc.) at least the following operations. The controller 250 can cause a gate 218 in the first feeder module 201 to direct sheets from the sheet feeding device 210 into the main sheet transport path 207 such that the sheets are transported through the main sheet transport path 207 and out the first output port 209 on the second side 204 of the frame 202. In the event of a print media sheet jam in the first compartment 205, the controller 250 can receive a sheet jam detection signal from any one or more of the sheet jam detection sensor(s) 211 in the first compartment 205. Then (i.e., after receiving the sheet jam detection signal(s)), the controller 250 can cause the gate 218 to direct the sheets from the sheet feeding device 210 into the bypass path 212 such that the sheets are transported through the bypass path 212 and out the second sheet output port 214 rather than out the first sheet output port 209 of the main sheet transport path 207.

This embodiment can further comprise a second feeder module 221 connected in series with the first feeder module 201. Specifically, the second feeder module 221 can be positioned upstream of the first feeder module 201 (i.e., preceding the first feeder 201 module in the series connection) and adjacent to the first side 203 of the first feeder module 201.

The second feeder module 221 can be configured such that it is essentially identical to the first feeder module 201 and can feed additional sheets (i.e., can be adapted to feed additional sheets) selectively into either the first input port 208 of the first feeder module 201 (and, thereby into the main sheet transport path 207) or the second input port 213 of the first feeder module 201 (and, thereby into the bypass path 212).

In this case, the controller 250 can further be operatively connected to the second feeder module 221 so as to control movement of the additional sheets from the second feeder module 221 into the main sheet transport 207 and bypass paths 212 of the first feeder module 201. Specifically, the controller 250 can further perform (i.e., be adapted to perform, programmed to perform, etc.) the following operations. The controller 250 can cause an additional gate 222 in the second feeder module 221 to direct the additional sheets into the first input port 208 of the first feeder module 201 such that the additional sheets are transported by the main sheet transport path 207 to the first output port 209 of the first feeder module 201. After receiving one or more sheet jam detection signals from the sheet jam detection sensor(s) 211 in the first compartment 205 of the first feeder module 201, the controller 250 can cause the additional gate 222 in the second feeder module 221 to direct the additional sheets from the second feeder module 221 into the second input port 213 of the first feeder module 201 such that the additional sheets are transported by the bypass path 212 through the first feeder module 201 rather than by the main sheet transport path 207.

This embodiment can further comprise an interface module 241 also connected in series with the first feeder module 201. Specifically, the interface module 241 can be positioned downstream of the first feeder module 201 (i.e., following the first feeder module 201 in the series connection) adjacent the second side 204 of the first feeder module 201. The interface module 241 can merge (i.e., can be configured to merge), into a single stream of sheets, all sheets received from the first output port 209 (i.e., from the main sheet transport path 207) and the second output port 214 (i.e., the bypass path 212) of the first feeder module 201 for subsequent processing (e.g., by a printing module 261).

During operation of the bypass path 212 (i.e., as sheets are transported through the bypass path 212 in the second compartment 206 of the first feeder module 201), a user can access the first compartment 205 through the access panel and can locate and correct the jam as detected by the jam detection sensor(s) 211. Thus, this embodiment allows for continued productivity even in the event of a print media sheet jam.

Referring to the embodiment 300 of FIG. 3, the first feeder module 301 can similarly comprise a support frame 302 having a first side 303 and a second side 304 opposite the first side 303. The frame 302 can be divided into multiple discrete compartments: a first compartment 305 (i.e., a main compartment) and multiple second compartments 306*a-b* (i.e., bypass path compartments). The first compartment 305 can comprise a main sheet transport path 307 and multiple sheet feeding devices (e.g., an upper sheet feeding device 310*a* and a lower sheet feeding device 310*b*), each of which are accessible through one or more access panels. The main sheet transport path 307 can extend between a first sheet input port 308 on one side of the frame 302 (e.g., on the first side 303) and a first sheet output port 309 on the opposite side of the frame 302 (e.g., on the second side 304). Additionally, one or more print media sheet jam detection sensors 311 can be positioned throughout the first compartment 305 adjacent to the main sheet transport path 307 and, optionally, adjacent to the sheet feeding devices 310*a-b* for detecting print media sheet jams contained therein.

The second or bypass path compartments 306*a-b* can, for example, be positioned both above and below the first compartment 305. Specifically, a second compartment 306*a* above the first compartment 305 can comprise an upper bypass path 312*a* extending between a second sheet input port 313*a* on the first side 303 of the frame 302 and a second sheet output port 314*a* on the second side 304 of the frame 302. Similarly, a second compartment 306*b* below the first compartment 305 can comprise a lower bypass path 312*b* extending between a third sheet input port 313*b* on the first side 303 of the frame 302 and a third sheet output port 314*b* on the second side 304 of the frame 302. In this embodiment, the upper sheet feeding device 310*a* contained in the first compartment 305 can be connected to both the main sheet transport path 307 and the upper bypass path 312*a* through an opening 316*a* between the first compartment 305 and the second compartment 306*a* above the first compartment 305. Thus, sheets from the upper sheet feeding device 310*a* can be selectively fed to either the main sheet transport path 307 or the upper bypass path 312*a*. Similarly, in this embodiment, the lower sheet feeding device 310*b* contained in the first compartment 305 can be connected to both the main sheet transport path 307 and the lower bypass path 312*b* through an opening 316*b* between the first compartment 305 and the second compartment 306*b* below the first compartment 305. Thus, sheets from the lower sheet feeding device 310*b* can be selectively fed to either the main sheet transport path 307 or the lower bypass path 312*b*.

In this embodiment, a controller 350 can be operatively connected to the first feeder module 301 so as to control movement of sheets into and through the main sheet transport path 307 and the upper and lower bypass paths 312*a-b*. Specifically, the controller 350 can perform (i.e., can be adapted to perform, programmed to perform, etc.) at least the following operations. The controller 350 can cause a first gate 318*a* to direct first sheets from the upper sheet feeding device 310*a* into the main sheet transport path 307 such that the first sheets are transported through the main sheet transport path 307 and/or can cause a second gate 318*b* to direct second sheets from the lower sheet feeding device 310*b* into the main sheet transport path 307 such that the second sheets are transported through the main sheet transport path 307. In the event of a print media sheet jam in the first compartment 305, the controller 350 can receive a sheet jam detection signal from any one or more of the sheet jam detection sensor(s) 311 in the first compartment 305. Then, (i.e., after receiving the sheet jam detection signal(s)), the controller 350 can cause the first gate 318*a* to direct the first sheets from the upper sheet feeding device 310*a* into the upper bypass path 312*a* such that the first sheets are transported through the upper bypass path 312*a* and out the second sheet output port 314*a* rather than out the first sheet output port 309 of the main sheet transport path 307 and/or can cause the second gate 318*b* to direct the second sheets from the lower sheet feeding device 310*b* into the lower bypass path 312*b* such that the second sheets are transported through the lower bypass path 312*b* and out the third sheet output port 314*b* rather than out the first sheet output port 309 of the main sheet transport path 307.

This embodiment can further comprise a second feeder module 321 connected in series with the first feeder module 301. Specifically, the second feeder module 321 can be positioned upstream of the first feeder module 301 (i.e., preceding the first feeder 301 module in the series connection) and adjacent to the first side 303 of the first feeder module 301. The second feeder module 321 can be configured such that it is essentially identical to the first feeder module 301 and can feed additional sheets (i.e., can be adapted to feed additional sheets) selectively into the first input port 308 of the first feeder module 301 (and, thereby the main sheet transport path 307), the second input port 313*a* of the first feeder module 301 (and, thereby the upper bypass path 312*a*) or the third input port 313*b* of the first feeder module (and, thereby the lower bypass path 312*b*).

In this case, the controller 350 can further be operatively connected to the second feeder module 321 so as to control movement of the additional sheets from the second feeder module 321 into the main sheet transport path 307 and the upper and lower bypass paths 312*a-b* of the first feeder module 301. Specifically, the controller 350 can further perform (i.e., be adapted to perform, programmed to perform, etc.) the following operations. The controller 350 can cause additional gates 322*a-b* in the second feeder module 321 to direct additional sheets (e.g., from upper and lower feeding devices in the second feeder module) into the first input port 308 of the first feeder module 301 such that the additional sheets are transported through the first feeder module 301 by the main sheet transport path 307 to the first output port 309. After receiving one or more sheet jam detection signals from the sheet jam detection sensor(s) 311 in the first compartment 305 of the first module 301, the controller 350 can cause the additional gates 322*a-b* in the second feeder module 321 to direct the additional sheets from the second feeder module 321 into the second or third input ports 313*a-b* of the first feeder module 301 such that the additional sheets are transported through the first feeder module 301 by the upper and lower bypass paths 312*a-b* to the second and third output ports 314*a-b*, respectively, rather than by the main sheet transport path 307.

This embodiment can further comprise an interface module 341 also connected in series with the first feeder module 301. Specifically, the interface module 341 can be positioned downstream of the first feeder module 301 (i.e., following the first feeder module in the series connection) adjacent the second side 304 of the first feeder module. The interface module can merge (i.e., can be configured to merge), into a single stream of sheets, all sheets received from the first output port 309 (i.e., from the main sheet transport path 307), the second output port 314*a* (i.e., the upper bypass path 312*a*) and the third output port 314*b* (i.e., the lower bypass path 312*b*) of the first feeder module 301.

During operation of the upper and lower bypass paths 312*a-b* (i.e., as sheets are transported through the upper and/or the lower bypass paths 312*a-b* in the second compartments 306*a-b* of the first feeder module 301), a user can access the first compartment 305 through the access panel(s) and can locate and correct the jam as detected by the jam detection sensor(s). Thus, this embodiment allows for continued productivity even in the event of a print media sheet jam.

It should be understood that the terms "printing device", "printing engines", "printing apparatus" and/or "printer" as used herein encompasses any of a digital copier, bookmaking machine, facsimile machine, multi-function machine, etc. which performs a print outputting function for in the manner described above using one or more intermediate transfer belts or one or more photoreceptor belts. The details of printing devices (e.g., printers, printing engines, etc.) are well-known by those ordinarily skilled in the art. Printing devices are readily available devices produced by manufactures such as Xerox Corporation, Norwalk, Conn., USA. Such printing devices commonly include input/output, power supplies, processors, media movement devices, marking/imaging devices etc., the details of which are omitted here from to allow the reader to focus on the salient aspects of the embodiments described herein. The term "print medium" as used herein encompasses any cut sheet or roll of print media substrate suitable for receiving images, such as, a paper, plastic, vinyl, etc.

It should further be understood that the terms "path", "transport path", "bypass path", etc., as used herein encompass all paths through which print media sheets are transported. Each such path can comprise one or more conventional sheet transport devices (e.g., nip apparatuses 180, 280, 380, as shown in FIGS. 1, 2 and 3, respectively) and/or transport belts) that are configured (e.g., with a drive roller) to cause print media sheets entering the path to be transported in a given direction. Additionally, the term "gate" as used herein encompasses a structure, such as a baffle or diverter, capable of pivoting movement in order to control the direction a sheet travels into or from a sheet transport path. Additionally, the term "jam" refers to a condition whereby a print media sheet becomes stalled, hung up, caught, etc. within a sheet transport path. The "print media sheet jam detection sensor" (e.g., see items 111, 211 and 311 of FIGS. 1-3) can comprise any suitable paper path sensor or other device for detecting print media sheet jams within a sheet transport path. Such sheet jam detection sensors are well-known by those ordinarily skilled in the art. Exemplary sheet jam detection sensors are disclosed in the following patent documents assigned to Xerox Corporation of Norwalk, Conn., USA, and incorporated herein by reference: U.S. Pat. No. 5,970,274 of Rath, issued on Oct. 19, 1999; U.S. Pat. No. 3,603,680 of Barton, issued on Sep. 7, 1971; and U.S. Pat. No. 6,507,725 of Adams et al., issued on Jan. 14, 2003.

It should further be understood that the term "sheet stacking device" (e.g., see item 110 of FIG. 1) can comprise any suitable device for receiving sheets of print media from, for example, a sheet transport path, and serially stacking such sheets. While the term "sheet feeding device" (e.g., see items 210 of FIG. 2 and items 310*a-b* of FIG. 3) can comprise any suitable device for feeding sheets into a sheet transport path. Such sheet stacking and sheet feeding devices are well-known by those ordinarily skilled in the art. Exemplary sheet stacking devices and/or sheet feeding device are disclosed in the following patent documents assigned to Xerox Corporation of Norwalk, Conn., USA, and incorporated herein by reference: U.S. patent application Ser. No. 12/211,853 of Bober et al., filed on Sep. 17, 2008; U.S. patent application Ser. No. 12/331,768 of Mandel et al., filed on Dec. 10, 2008; U.S. Patent Publication No. 2008/0265483 of Hermann, published on Oct. 30, 2008; U.S. Patent Publication No. 2008/0145090 of Robinson, published on Jun. 19, 2008; U.S. Patent Application Publication No. 2006/0214352 of Clark, published on Sep. 28, 2006; U.S. Pat. No. 5,518,230 of Scarlata et al., issued on May 21, 1996; U.S. Pat. No. 6,748,186 of Skrainar et al., issued on Jun. 8, 2004; U.S. Pat. No. 7,280,771 of Mandel et al., issued on Oct. 9, 2007; and U.S. Pat. No. 7,280,781 of Willis, issued on Oct. 9, 2007.

Furthermore, it should be understood that the term "controller" (e.g., see items 150, 250 and 350 of FIGS. 1-3) as used herein can preferably comprise a programmable, self-contained, dedicated mini-computer having a central processor unit (CPU), electronic storage, and a display or user interface (UI) and can function as the main control system for the multiple modules (e.g., the feeder module(s), stacker module(s), interface modules(s) printing module(s), etc.) within the modular printing systems 100, 200, 300.

Finally, it should further be understood that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

Therefore, disclosed above are embodiments of a modular printing system with one or more modules having one or more bypass paths. Specifically, embodiments disclosed herein comprise a modular printing system with a module (e.g., a stacker or feeder module) having a main compartment and at least one additional compartment. Contained within the main compartment is a main sheet transport path and a functional component (e.g., a sheet stacking device or a sheet feeding device) connected to the main sheet transport path. Contained with the additional compartment is a bypass path. The bypass path allows sheets to be routed through the module in the event of a print media sheet jam in the main sheet transport path. Because the bypass path is contained within a separate compartment, the jam can be cleared from the main compartment without cycling down the printing system, thereby allowing for continued productivity.

What is claimed is:

1. A printing system:

a first module comprising:

a frame having a first side and a second side opposite said first side, said frame comprising a first compartment and a second compartment above said first compartment;

a main sheet transport path in said first compartment and extending between a first input port on said first side and a first output port on said second side;

at least one sheet jam detection sensor in said first compartment adjacent to said main sheet transport path; and a bypass path in said second compartment extending between a second input port on said first side and a second output port on said second side;

a second module adjacent said first side of said first module, said second module selectively feeding sheets to one of said first input port and said second input port;

an additional module adjacent said second side of said first module; and a controller operatively connected to said first module and said second module so as to control movement of sheets into and through said main sheet transport path and said bypass path, said controller further performing the following operations:

causing a gate in said second module to direct said sheets into said first input port such that said sheets are transported through said main sheet transport path;

receiving a sheet jam detection signal from said sheet jam detection sensor; and in response to said receiving of said sheet jam detection signal, causing said gate in said second module to direct said sheets into said second input port such that said sheets are transported through said bypass path and out said second output port to said additional module for additional processing, said first compartment further comprising an access panel to said main sheet transport path, said access panel providing a user with access to said main sheet transport path in said first compartment for correcting a jam condition in said main sheet transport path as indicated by said sheet jam detection signal, and said bypass path continuing to transport said sheets to said additional module for said additional processing during said correcting of said jam condition by said user through said access panel such that cycling down of said printing system to perform said correcting is avoided.

2. The printing system of claim 1, said second compartment comprising a discrete compartment relative to said first compartment, and said continuing, by said bypass path, to transport said sheets to said additional module for said additional processing ensuring continued productivity by said printing system during said correcting of said jam condition by said user through said access panel.

3. The printing system of claim 1, said first module comprising a first stacker module comprising a sheet stacking device connected to said main sheet transport path; and said second module comprising an interface module between said first stacker module and one of a printing module and a second stacker module.

4. A printing system:

a first stacker module comprising:

a frame having a first side and a second side opposite said first side, said frame comprising a first compartment and a second compartment above said first compartment;

a main sheet transport path in said first compartment extending between a first input port on said first side and a first output port on said second side;

a sheet stacking device in said first compartment connected to said main sheet transport path;

at least one sheet jam detection sensor in said first compartment adjacent to said main sheet transport path and said sheet stacking device; and a bypass path in said second compartment extending between a second input port on said first side and a second output port on said second side;

a first interface module adjacent said first side of said first stacker module, said first interface module selectively feeding sheets to one of said first input port and said second input port;

an additional module adjacent said second side of said first module; and a controller operatively connected to said first stacker module and said first interface module so as to control movement of sheets into and through said main sheet transport path and said bypass path, said controller further performing the following operations:

causing a first gate in said first interface module to direct said sheets into said first input port such that said sheets are transported through said main sheet transport path and further causing a second gate in said first stacker module adjacent said main sheet transport path to selectively direct said sheets into one of said first output port and said sheet stacking device;

receiving a sheet jam detection signal from said sheet jam detection sensor; and in response to said receiving of said sheet jam detection signal, causing said first gate in said first interface module to direct said sheets into said second input port such that said sheets are transported through said bypass path and out said second output port to said additional module for additional processing, said first compartment further comprising an access panel providing a user with access to said main sheet transport path and said sheet stacking device in said first compartment for correcting a jam condition in any one of said main sheet transport path and said sheet stacking device as indicated by said sheet jam detection signal, and said bypass path continuing to transport said sheets to said additional module for said additional processing during said correcting of said jam condition by said user through said access panel such that cycling down of said printing system to perform said correcting is avoided.

5. The printing system of claim 4, said first stacker module further having a top surface with an additional output port, said bypass path being above said main sheet transport path and branching to said additional output port, and said controller further causing a third gate in said first stacker module adjacent said bypass path to selectively direct any sheet transported through said bypass path to one of said second output port and said additional output port.

6. The printing system of claim 5, said additional output port being connected to an output tray on said top surface.

7. The printing system of claim 4, further comprising a second stacker module, said additional module comprising a second interface module between said first stacker module and said second stacker module, said second stacker module being essentially identical to said first stacker module and said second interface module being configured to receive said sheets from any one of said first output port and said second output port of said first stacker module and to feed said sheets to any one of multiple input ports on said second stacker module.

8. A printing system:

a first stacker module comprising:

a frame having a first side and a second side opposite said first side, said frame comprising a first compartment and a second compartment above said first compartment;

a main sheet transport path in said first compartment and extending between one of multiple first input ports on said first side and a first output port on said second side;

a sheet stacking device in said first compartment connected to said main sheet transport path;

at least one sheet jam detection sensor in said first compartment adjacent to said main sheet transport path and said sheet stacking device; and a bypass path in said second compartment extending between a second input port on said first side and a second output port on said second side;

a first interface module adjacent said first side of said first stacker module, said first interface module comprising multiple output ports, a portion of said main sheet transport path being selectively movable in order to align said one of said multiple first input ports on said first stacker module with one of said multiple output ports on said first interface module, said first interface module selectively feeding sheets into said one of said multiple first input ports and said second input port;

an additional module adjacent said second side of said first module; and a controller operatively connected to said first stacker module and said first interface module so as to control movement of sheets into and through said main sheet transport path and said bypass path of said first stacker module, said controller further performing the following operations:

causing a first gate in said first interface module to direct said sheets into said one of said multiple first input ports such that said sheets are transported through said main sheet transport path and further causing a second gate in said first stacker module adjacent said main sheet transport path to selectively direct said sheets into one of said first output port and said sheet stacking device;

receiving a sheet jam detection signal from said sheet jam detection sensor; and in response to said receiving of said sheet jam detection signal, causing said first gate in said first interface module to direct said sheets into said second input port such that said sheets are transported through said bypass path and out said second output port to said at least one additional module for additional processing, said first compartment further comprising an access panel providing a user with access to said main sheet transport path and said sheet stacking device in said first compartment for correcting a jam condition in any one of said main sheet transport path and said sheet stacking device as indicated by said sheet jam detection signal, and said bypass path continuing to transport said sheets to said additional module for said additional processing during said correcting of said jam condition by said user through said access panel such that cycling down of said printing system to perform said correcting is avoided.

9. The printing system of claim 8, said first stacker module further having a top surface with an additional output port, said bypass path being above said main sheet transport path and branching to said additional output port, and said controller further causing a third gate in said first stacker module adjacent said bypass path to selectively direct any sheet transported through said bypass path to one of said second output port and said additional output port.

10. The printing system of claim 9, said additional output port being connected to an output tray on said top surface.

11. The printing system of claim 8, further comprising a second stacker module, said additional module comprising a second interface module between said first stacker module and said second stacker module, said second stacker module being essentially identical to said first stacker module and said second interface module being configured to receive said sheets from any one of said first output port and said second output port of said first stacker module and to feed said sheets to any one of multiple input ports on said second stacker module.

12. The printing system of claim 4, said second compartment comprising a discrete compartment relative to said first compartment, and said continuing, by said bypass path, to transport said sheets to said additional module for said additional processing ensuring continued productivity by said printing system during said correcting of said jam condition by said user through said access panel.

13. The printing system of claim 11, said second compartment comprising a discrete compartment relative to said first compartment, and said continuing, by said bypass path, to transport said sheets to said additional module for said additional processing ensuring continued productivity by said printing system during said correcting of said jam condition by said user through said access panel.

* * * * *